United States Patent [19]

Aspenwall

[11] Patent Number: 5,040,101

[45] Date of Patent: Aug. 13, 1991

[54] LIGHTING SYSTEM FOR DISPLAY CABINET

[76] Inventor: John E. Aspenwall, 301 Draper La., Provo, Utah 84603

[21] Appl. No.: 511,401

[22] Filed: Apr. 19, 1990

[51] Int. Cl.[5] ..... A47F 11/10

[52] U.S. Cl. ..... 362/125; 362/269; 362/418; 312/223

[58] Field of Search ..... 362/125, 133, 269, 287, 362/418, 427, 220, 457; 312/223

[56] References Cited

U.S. PATENT DOCUMENTS

| | | | |
|---|---|---|---|
| 661,505 | 11/1900 | Erikson | 362/125 |
| 723,943 | 3/1903 | Taussig et al. | 362/287 |
| 1,134,132 | 4/1915 | Hotchkin | 362/125 |
| 1,927,254 | 9/1933 | Benjamin | 362/125 |
| 4,302,800 | 11/1981 | Pelletier | 362/287 |
| 4,535,393 | 8/1985 | Aspenwall | 362/125 |
| 4,739,454 | 4/1988 | Federgreen | 362/133 |

*Primary Examiner*—Allen M. Ostrager
*Assistant Examiner*—Richard R. Cole
*Attorney, Agent, or Firm*—M. Reid Russell

[57] ABSTRACT

A lighting system for display cases wherein a tubular housing for a lamp or lamps is secured to a display case frame in an unobtrusive manner and is rotatably adjustable to optimally direct emitted light.

2 Claims, 2 Drawing Sheets

LIGHTING SYSTEM FOR DISPLAY CABINET

BACKGROUND OF THE INVENTION

1. Field of the Invention

This invention relates to see-through display cabinets and is particularly concerned with the systems that are used to mount light tubes within the cabinets such that the tubes effectively and adjustably illuminate items placed in the cabinets and can be easily removed and installed.

2. Prior Art

It has long been desirable that display cases or cabinets be provided with windows through which products placed in the cabinet can be viewed. It has become even more desirable in recent years to make the frames for such cabinets narrow and to have larger glass areas. Consequently, it has become more and more important that lighting systems be provided for the cases or cabinets that will allow the contents to be illuminated for display, but wherein the lighting system itself be unobtrusive while still providing the necessary illumination.

U.S. Pat. No. 1,764,999, discloses an electric lighting system for a display case wherein electric wiring is hidden in the frame of the case and exteriorly mounted lamps in outer shells have inner curved deflectors to direct light into the case.

U.S. Pat. Nos. 665,264, 845,652, and 892,235, disclose show cases with light systems that include lamps and curved light and heat deflectors with means to secure the systems to frame structures of the cases, and an illuminating indicating instrument is shown in U.S. Pat. No. 2,982,847. None of which devices and systems shows a mounting like the present invention. U.S. Pat. No. 4,598,341, discloses a display case lighting system wherein one or more fluorescent tubes are supported by an extrusion mounted to corner frame members of the case and are supported thereto by a system of interdigitated flanges.

OBJECT OF THE INVENTION

Principal object of the invention are to provide a lighting system that is easily and securely attached to narrow frame members at the interior of a display case and that does not obscure viewing of the contents of the case.

Other objects are to provide a lighting system that includes a reflector to direct the light and is adjustable to vary the direction of the light into the display case.

Still another object is to provide a lighting system that provides for location of the electrical wiring for the system to be hidden from view and protected against the possibility of dangerous heating of the wiring.

FEATURES OF THE INVENTION

Principal features of the invention include a lighting system for a display case that has anchor members secured to corner reinforcement members of extrusions that make up the frame members of the case. The anchor members include curved and slotted end brackets, which slots are curved to receive arcuate flanges of circular end pieces that are arranged at opposite ends of a curved lamp housing. One of which circular end pieces includes a tubing elbow that is journaled therethrough for permitting introduction of electrical wiring into the lamp housing.

A pair of spaced apart ribs, known in the industry as a screw way, extend the length of the lamp housing to form a channel for electrical wires. Which wires may be passed through holes that are provided in the circular end pieces and are aligned with the channel to electrically interconnect adjacent lamp housings, as desired.

One or more lamp holders, each comprising a backing plate that overlies a portion of the channel and a pair of end flanges having curved outermost edges and connector ears are provided that fit within the lamp housing. A lamp socket is attached to one or both of the end flanges and conventional elongate light tubes are arranged to be serially plugged into the socket to extend longitudinally in the lamp housing.

Other objects and features of the invention will become apparent from the following detailed description and drawing disclosing what are presently contemplated as being the best modes of the invention.

THE DRAWINGS

In the drawings:

FIG. 1 is a perspective view of the lighting system of the invention taken from below and at one end, installed in a display case, shown fragmentarily, and with housing covers exploded away for clarity;

FIG. 2, a vertical sectional view, taken on the line 2-2 of FIG. 1;

FIG. 3, an enlarged and exploded perspective view of an anchor assembly of the light system of FIG. 1; and FIG. 4, a vertical section, taken on the line 4-4 of FIG. 1, but with the end plate assembled.

DETAILED DESCRIPTION OF THE INVENTION

Figure 1:
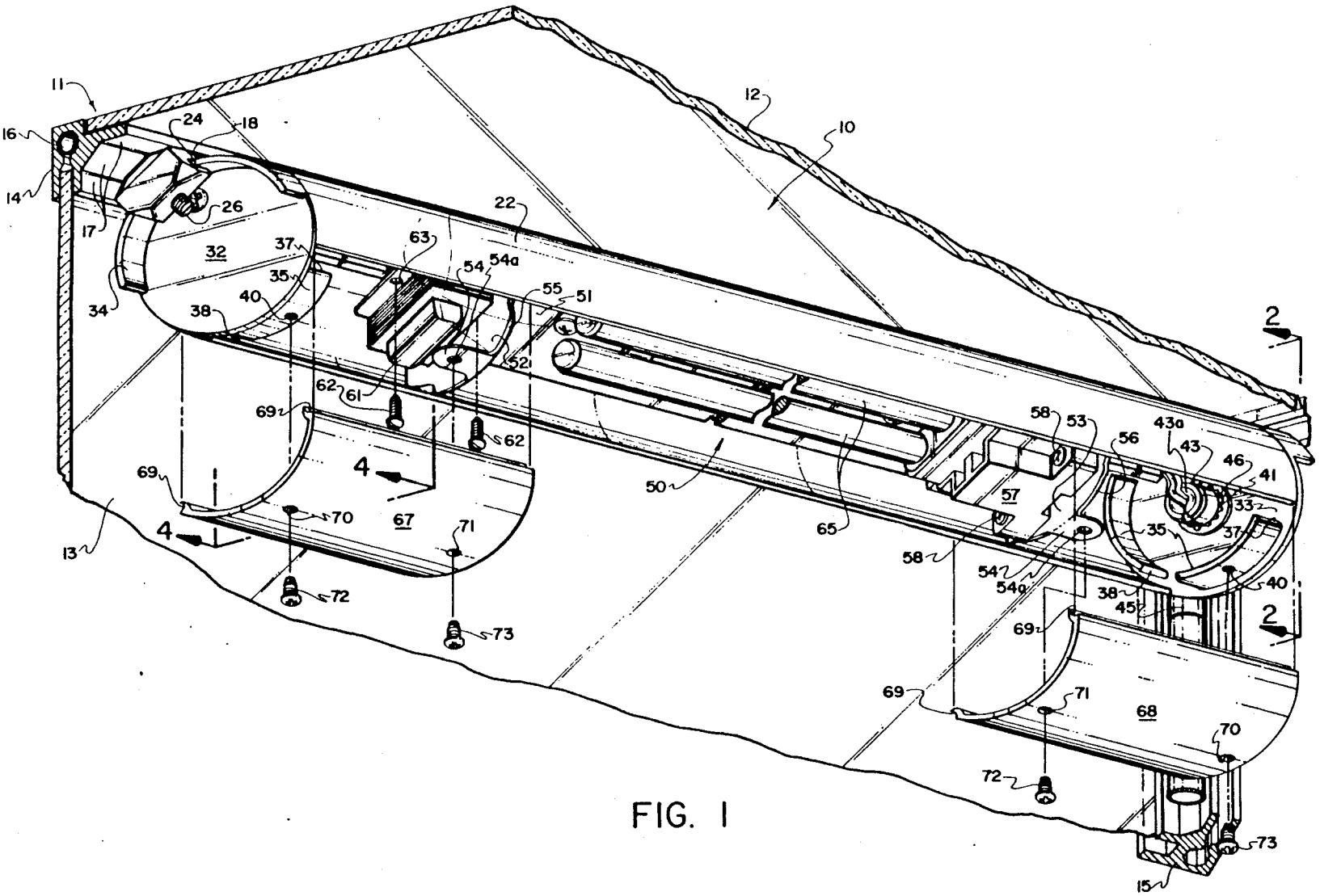

Referring now to the drawings:

In the illustrated preferred embodiment, the mounting system for light tubes, shown generally at 10, is mounted in a display cabinet 11.

The display cabinet is shown fragmentarily to include a transparent top 12, and a transparent end wall 13.

Figure 2:
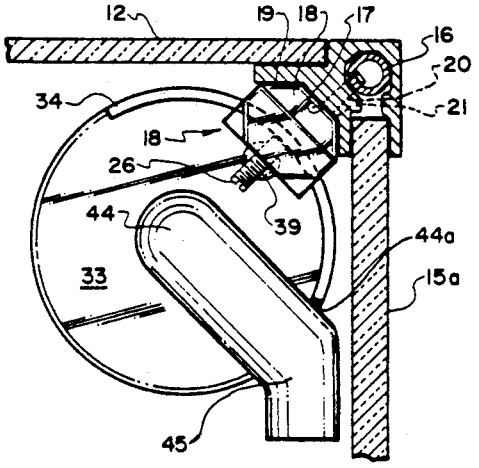
Figure 4:
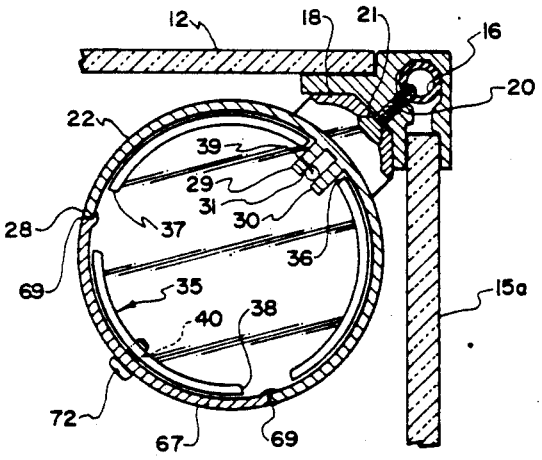

The transparent top 12 and end wall 13 are interconnected by a corner extrusion 14, and another similar corner extrusion 15 interconnects transparent top 12 and a sidewall 15*a* (FIGS. 2 and 4). It should be understood that the display case, shown fragmentarily in FIG. 1, includes the usual bottom and another end wall which are not shown.

The corner extrusions 14 and 15, a junction of the sidewall, end wall and top includes a three sided inner face 17 and accommodates a tubular reinforcement member 16 inserted therein.

Oppositely facing anchor members 18 each having a three sided back surface 19 that will nest against the inner face 17 of a top frame extrusion to which a lighting system is affixed. Self-tapping screws 20 (FIGS. 2 and 3) are inserted through holes 21 that are provided therefore in the anchor members 18, which self tapping screws 20 are threaded through the back face 19 of the extrusion and into the reinforcement member 16, as shown best in FIGS. 2 and 4, and additional to hanging the anchor members 18 to the frame, provide frame support also. The anchor members 18, positioned at opposite ends of a lamp housing 22 are thus securely attached to an extrusion member forming a part of and rigidizing the frame of the display case 11.

Figure 3:
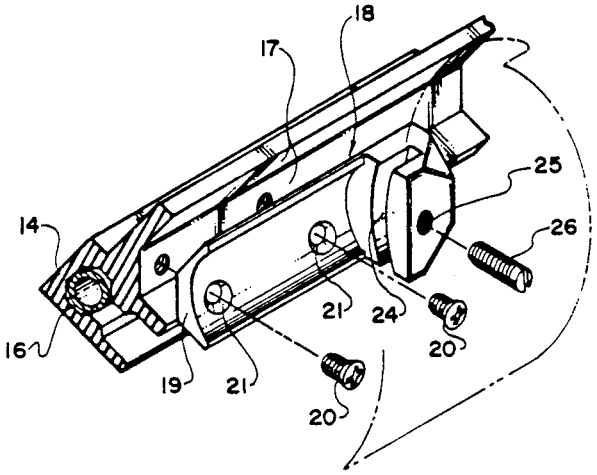

Shown best in FIGS. 1 and 3, each of the anchor members 18 has a curved slot 24 formed therein and includes a threaded hole 25 that opens into that curved slot and receives a set screw 26 to lock the lamp housing 22 in place, as will be hereafter described.

Lamp housing 22 is a partial cylinder that is open at one side 28. A pair of spaced apart ribs 29 and 30, known in the industry a screw way, extend the length of the housing and are centrally positioned opposite the opening 28 to form a channel 31 in which electrical wires may be positioned.

A pair of end walls 32 and 33 are provided to lamp housing 22 that each have an arcuate exterior flange 34 that is arranged to fit into a slot 24 of an anchor member 18 for mounting the lamp housing. The arcuate exterior flanges 34 are turned in the anchor member rotational curved slot 24 to accommodate positioning of the lamp housing 22 and the opening 28 thereof.

Shown in FIGS. 1 and 4, each of the end walls 32 and 33 also has an interior peripheral flange 35, with notches 36, 37 and 38 formed therein. The peripheral flanges 35 are curved to telescope snugly into the ends of curved lamp housing 22, with notches 36 straddling the ends of ribs 29 and 30. So arranged, the ribs 29 and 30 prevent turning of the housing 22 relative to the end walls 32 and 33.

Shown in FIGS. 1 and 4, a hole 39 is formed through each end wall 32 and 33 to be aligned with channel 31. The notches 37 and 38 are provided to be positioned at opposite edges of the curved housing 22 and a threaded hole 40 is provided through each flange 35 and centrally between the notches 37 and 38.

Shown in FIGS. 1 and 2, a central hole 41 is provided through end plate 32 to receive one end 43 of a tubing elbow 44, which end 43 may include a cord restraint **43*a* that is essentially opposing flexible flanges that are biased towards one another and receive electrical cord or wires therethrough the flange edges to bind thereagainst, restricting cord or wire slippage. The other end 45 of which tubing elbow extends along the three sided face of the extrusion 15, shown best in FIG. 2. The tubing elbow 44 includes a dog leg bind 44*a* into end 45. The elbow extending from end 43, across end plate 32 to the bind 44*a* that engages the arcuate exterior flange 34 end resting thereagainst when the elbow is pivoted appropriately. The spring nut 46 is provided to lock the elbow 44 in place while allowing rotation of the lamp housing 22** relative to the tubing elbow or tubing elbow relative to the lamp housing.

A lamp holder is shown generally at 50 in FIG. 1, and includes a backing plate 51 interconnecting projecting end flanges 52 and 53, that fit within the lamp housing 22 such that the backing plate is positioned across the ribs 29 and 30 and encloses a portion of channel 31. The outermost edges 55 and 56, respectively, of the flanges 52 and 53 are arcuately curved and each has a right angle outwardly projecting ear 54 wherethrough a threaded hole **54*a* is formed. Holes, are provided through flange 53 that permit an electrical lamp socket 57 to be bolted thereto by bolts 58 and nuts 59. A ballast 61 includes planar flanges 60 extending from each ballast end for use in mounting the ballast within the lamp housing 22 by turning metal screws 62 and 63 through sides 64 in each of the flanges and between the spaced apart ribs 29 and 30 that form the screw way. The ballast 61 is used if the light tube or tubes 65** used are either halogen or fluorescent lamps.

Curved housing covers 67 and 68 are provided that each have a curvature to conform to that of lamp housing 22 completing a cylinder and with lips 69 formed on the opposite edges thereof to snap under and into engagement with the edges of lamp housing 22.

Holes 70 and 71 are provided in each of the end covers 67 and screws 72 are provided for insertion through the holes 70 and into holes **54*a* in the flanges 54, thereby securing the housing covers to the end plates 31 and 32. Screws 73 inserted through the holes 71 and into the ears 40 secure the lamp holder to the end walls 32 and 33, holding the lamp holder in place in the lamp housing 22**.

It should be apparent that the lamp housing 22 may be of any desired length. It should also be apparent that more than one lamp holder, with its backing plate flanges and attached light socket and lamp, can be positioned in the lamp housing 22. If more than one lamp holder 50 is positioned within the housing an additional housing cover, like the covers 67 and 68 heretofore described, are snapped into the openings adjacent to flanges 52 and 53 thereof and are secured to the additional housing cover (not shown) by screws 73 inserted through the holes provided therefor in the housing cover and threaded into the holes **54*a* in the ears 54** of the adjacent backing members.

Regardless of the length of housing 22 and the number of lamp holders used, the only exposed portion of the system exposed to view through the transparent top is the cylindrically shaped lamp housing 22. The lamp housing 22 is readily rotated to direct light from the light tube 65 and as reflected from the inner wall of the tubular housing to give a desired lighting effect inside the display case. The housing 22 and housing covers are preferably made from aluminum, with an attractive polished, burnished or painted finish that will not detract from the overall appearance of the display cabinet.

Although a preferred form of my invention has been herein disclosed, it is to be understood that the present disclosure is by way of example and that variations are possible without departing from the subject matter coming within the scope of the following claims and a reasonable equivalency thereof, which subject matter I regard as our invention.

I claim:

1. A lighting system for display cases and the like comprising a pair of spaced apart anchor means that each include a curved slot therein; means for fixing each of said anchor means to a display case frame; a tubular housing having an opening at one side thereof; means for attaching opposite ends of said tubular housing to said spaced apart anchor means such that the tubular housing can turn about its longitudinal axis, in which said attaching means consists of tubular housing end walls that include curved flanges extending outwardly each curved flange for fitting into each said anchor means curved slot to turn therein; at least one lamp holder assembly; means to fix said lamp holder assembly in said housing; and a light tube electrically connected into said lamp holder assembly.

2. A lighting system as in claim 1, wherein each lamp holder includes a backing plate with end flanges projecting from opposite ends thereof, one of said flanges including means for mounting a ballast thereon and the other of said flanges for mounting a lamp socket thereon to receive a selected light tube; housing covers that close portions of the opening of the housing while leaving openings aligned with each light tube; and means for releasably securing each of said housing covers to an end flange of the backing plate.

* * * * *